United States Patent [19]

Sanborn et al.

[11] Patent Number: 4,686,888

[45] **Date of Patent: * Aug. 18, 1987**

[54] TURRET SYSTEM FOR LIGHTWEIGHT MILITARY VEHICLE

[75] Inventors: Steven L. Sanborn, Warren; Martin J. Neumeyer, Utica, both of Mich.

[73] Assignee: AM General Corporation, Detroit, Mich.

[ * ] Notice: The portion of the term of this patent subsequent to Mar. 11, 2003 has been disclaimed.

[21] Appl. No.: 835,464

[22] Filed: Mar. 3, 1986

Related U.S. Application Data

[60] Division of Ser. No. 736,218, May 20, 1985, Pat. No. 4,574,685, which is a continuation of Ser. No. 506,802, Jun. 22, 1983, abandoned.

[51] Int. Cl.[4] ..... F41F 21/08

[52] U.S. Cl. ..... 89/37.13; 89/40.03; 89/41.02

[58] Field of Search ..... 89/1.802, 1.815, 36.08, 89/36.13, 37.13, 40.03, 40.04, 41.01, 41.02

[56] References Cited

U.S. PATENT DOCUMENTS

| | | | |
|---|---|---|---|
| 641,897 | 1/1900 | Simms | 89/36.08 |
| 853,625 | 5/1907 | Charron | 89/40.03 |
| 2,367,837 | 1/1945 | Stevens | 89/40.03 |
| 2,373,990 | 4/1945 | Barnhart | 89/41.02 |
| 2,399,200 | 4/1946 | Brown | 89/41.12 |
| 2,404,459 | 7/1946 | Roeder et al. | 89/36.13 |
| 2,925,012 | 2/1960 | Malloy et al. | 89/1.815 |
| 3,316,809 | 5/1967 | Riedel | 89/1.815 |
| 3,357,718 | 12/1967 | Cadiou | 280/96.1 |
| 3,401,598 | 9/1968 | Sons | 89/40.03 |
| 3,424,052 | 1/1969 | Ruf | 89/37.03 |
| 3,429,222 | 2/1969 | Whiston et al. | 89/41.01 |
| 3,501,997 | 3/1970 | Winsen et al. | 89/44.02 |
| 3,504,122 | 3/1970 | Ratliff, Jr. | 178/6.5 |
| 3,566,742 | 3/1971 | Bemiss | 89/40.03 |
| 3,854,377 | 12/1974 | Schiele | 89/36.13 |
| 3,954,041 | 5/1976 | Mechulam et al. | 89/36.13 |
| 4,054,080 | 10/1977 | Rossel et al. | 89/36.08 |
| 4,574,685 | 3/1986 | Sanborn et al. | 89/36.13 |

FOREIGN PATENT DOCUMENTS

| | | | |
|---|---|---|---|
| 545880 | 9/1957 | Canada | 89/36.08 |
| 652191 | 11/1962 | Canada . | |
| 531605 | 1/1922 | France | 89/40.04 |
| 798816 | 5/1936 | France | 89/37.17 |
| 849186 | 8/1939 | France | 84/37 |
| 489059 | 7/1938 | United Kingdom | 89/37.17 |
| 492583 | 9/1938 | United Kingdom | 89/36.13 |
| 1019430 | 2/1966 | United Kingdom | 89/41.01 |

OTHER PUBLICATIONS

Popular Mechanics, "Remote Control Gun is Fired From Inside Car", May, 1945, p. 49.

Hoeltzel et al., "2 Fighting Vehicle Concept Designs", Army Research Development & Acquisition Magazine, Nov.-Dec., 1982, p. 19.

*Primary Examiner*—Stephen C. Bentley

*Attorney, Agent, or Firm*—Harness, Dickey & Pierce

[57] ABSTRACT

A lightweight military vehicle is provided with an unmanned turret for interchangeably supporting large weapon stations. Elastomer filled stanchions connected to a turret platform serve to isolate weapon impulse forces from the vehicle frame. Driver, commander and gunner seats are located externally to the turret and provided with said doors to enable quick exiting. Both powered and manual backup drives are external to the rotating turret disk and are accessible from the gunner's seat. The elevation drive employs a ball and socket joint connecting an upper yoke mounted to the weapon with a fixed lower portion controlling vertical movement of the yoke and thereby the elevation of the gun.

15 Claims, 8 Drawing Figures

TURRET SYSTEM FOR LIGHTWEIGHT MILITARY VEHICLE

This is a division of application Ser. No. 736,218, filed May 20, 1985 entitled "Turret System for Lightweight Military Vehicle", now U.S. Pat. No. 4,574,685, which is a continuation application of U.S. Ser. No. 506,802, filed June 22, 1983, now abandoned.

DESCRIPTION

1. Technical Field

This invention relates to ordinances and, more particularly, to weapon turret systems for a military vehicle.

2. Background Art

It is highly desirable to be able to employ a basic vehicle design that can be adapted to be used in various configurations for different military purposes. Examples of such desirable configurations include vehicles for transporting cargo or personnel, ambulances, command vehicles and as a weapons carrier. In order to provide this versatility where speed is important in most configurations and to facilitate transport by airlifts and the like, the basic vehicle must normally be relatively light.

When used as a weaspons carrier these lightweight vehicles have generally been restricted in the size of the weapon that it can support. It has been conventional to mount manually operated machine guns on a ring connected to the roof of the vehicle. The gunner is required to stand up in the vehicle with his upper torso exposed while aiming and firing the weapon. These types of weapon mounts have several drawbacks. One is that they expose the gunner to enemy fire, toxic gases, radiation and the like. The other is that only relatively small caliber weapons could be used with reasonable success. This is because the impulse forces generated by many larger caliber weapons (e.g. larger than .50 caliber) create such impulses that damage to commonly used lightweight vehicles could occur.

It has been normal practice to use heavier vehicles such as tanks, half-tracks or the like to support medium to large caliber weapons. Typically, the tanks include a turret having a protected personnel compartment which carries the gunner and is rotated with the turret. This approach keeps the gunner shielded but adds substantial weight and increased silhouette to the vehicle. Consequently, these heavier vehicles sacrifice mobility and transportability in order to protect the gunner and support the weapon. Additionally, many of the known tank configurations are characterized by cramped quarters which are uncomfortable and hard to quickly exit in emergency situations. Many tanks include hatches in the hull roof structure thereby requiring that the turret be indexed to a position that will allow the hull hatch to open to allow exiting by the crew.

Power drives are normally used for controlling the elevation and azimuth of the weapon. The power drives are often located in the turret thereby requiring slip rings or the like to transfer power from a fixed external electrical or hydraulic source to the drive motors. These slip rings are subject to corrosion and general deterioration thereby posing a threat of drive failure. It would be advantageous to provide manual backup systems that can maneuver the weapon in the event of power failure. The inclusion of manual backup drives has been difficult to obtain in an efficient manner with some of the turret constructions used in the past.

SUMMARY OF THE INVENTION

The present invention incorporates several features that may be used alone or in combination but when combined cooperate to provide an optimum lightweight vehicle construction capable of supporting relatively large weapon systems.

The preferred embodiment employs a turret construction having a disk rotatably mounted on a platform. The platform is connected to the vehicle frame by way of a plurality of stanchions. Preferably, the stanchions are potted or filled with a elastomeric material to help isolate the vehicle from impulse forces generated by the weapon. The crew sits in chassis/hull mounted seats, one of the seats being reversed for a gunner. The crew is thus provided with comfortable quarters and are preferably provided with exterior side doors adjacent each seat for quick exit if required. Both powered and manual backup drives are provided for moving the weapon in elevation and azimuth. The elevation drive includes a stationarily mounted lower portion having a manually actuable member accessible by the gunner from his seat. The upper portion of the elevation drive is rotatably coupled to the lower portion so that the upper portion may rotate with the turret during azimuth positioning and yet still provide elevation control.

Among the advantages of the turret construction of this invention is that the crew members are located comfortably within the protected interior of the vehicle. Since the gunner does not ride in the turret, the turret construction is simplified, of minimal silhouette and comparatively lightweight. As will appear, the construction of the present invention enables various weapons and/or weapon stations to be interchangeably used in an easy manner. All of these advantages and more are provided while employing a basic lightweight vehicle design that can be used in a variety of other configurations as desired.

BRIEF DESCRIPTION OF THE DRAWINGS

These and other advantages of the present invention will become apparent to those skilled in the art after reading the following specification and by reference to the drawings in which.

DESCRIPTION OF THE PREFERRED EMBODIMENT

Figure 1:
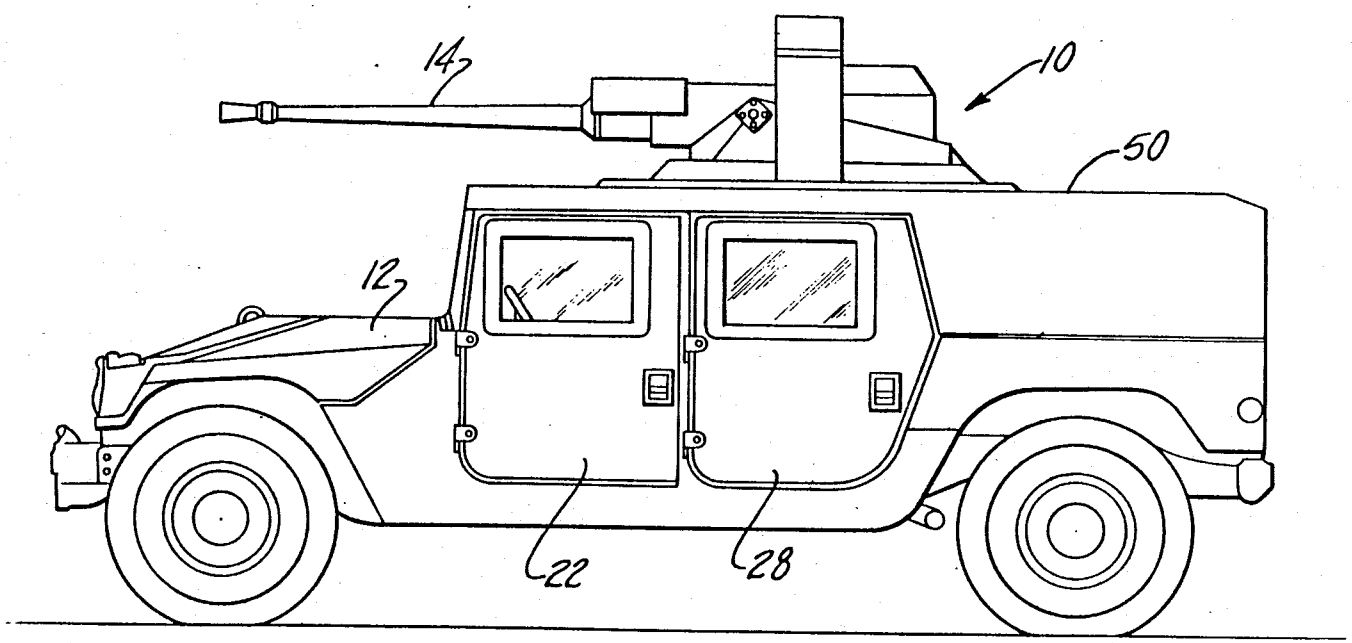
FIG. 1 is a side view of a military vehicle incorporating the teachings of the preferred embodiment of this invention.

Referring now to the drawings, the present invention employs a turret system 10 that may be used in connection with a lightweight vehicle 12. Vehicle 12 is designed to meet requirements for a high mobility, multipurpose wheeled vehicle. For purposes of this invention a lightweight vehicle means a wheeled vehicle having a gross vehicle weight of less than 10,000 pounds including payload. These drawings illustrate the "Hummer" vehicle manufactured by the assignee of the present invention, although other lightweight vehicles can be employed. Such lightweight vehicles are capable of being used in various configurations. One configuration is as a weapon carrier. The present invention is drawn to this configuration. More particularly, it is directed to a turret construction capable of supporting large weapons such as gun 14 which is a 25 millimeter M242 chain gun. Large weapons will be defined for purposes of this invention as weapons characterized by impulse forces (recoil force×duration) of at least about 50 pounds-seconds during firing. Generally, weapons of this type are of the variety greater than .50 caliber. By way of illustration the M242 chain gun 14 exhibits an impulse force of about 60 pounds-seconds.

Figure 2:
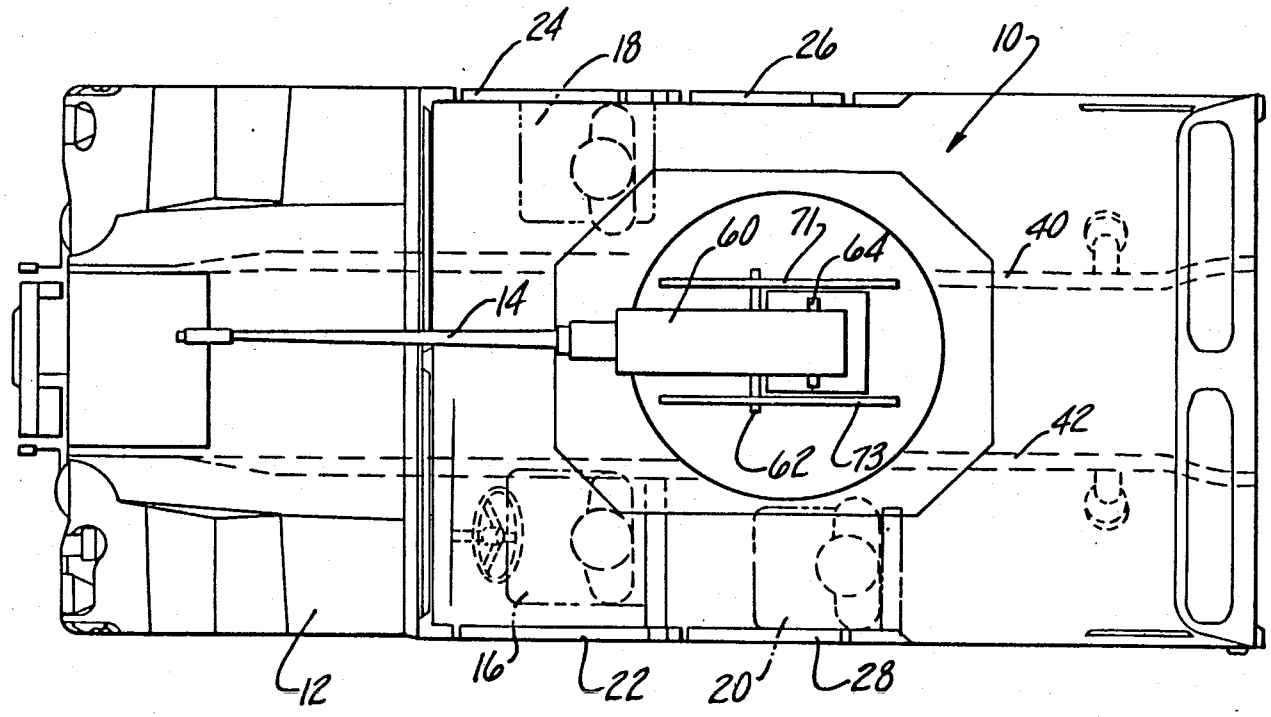
FIG. 2 is a top view thereof.
Figure 3:
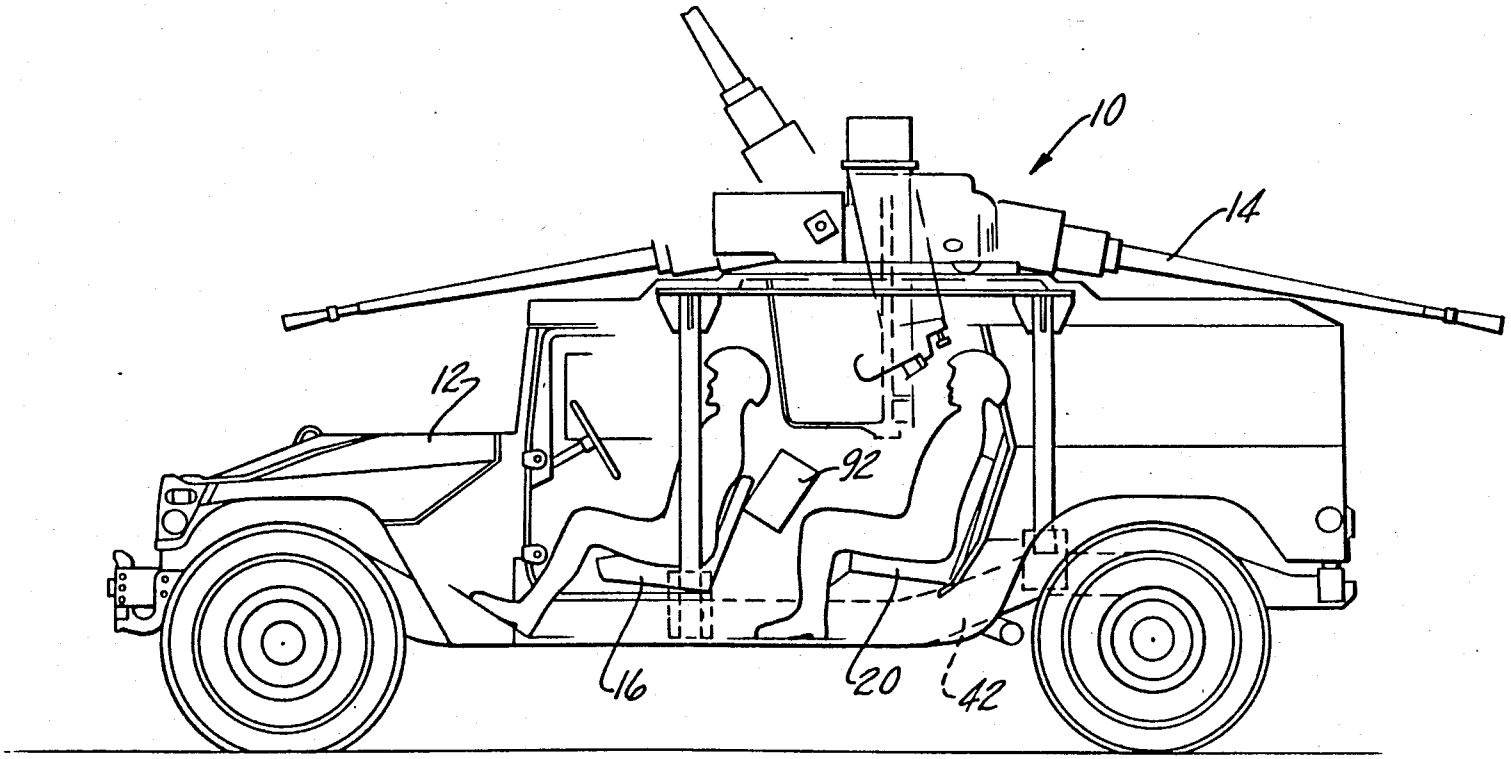
FIG. 3 is a view similar to FIG. 1 of the vehicle showing the gun in various orientations.
Figure 4:
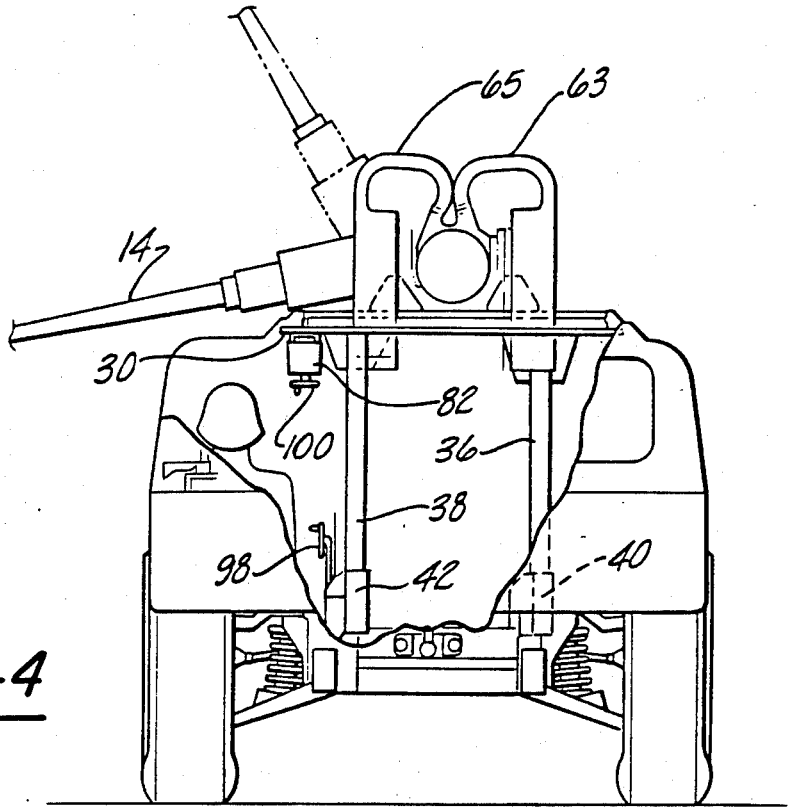
FIG. 4 is a rear view thereof.

The exterior of vehicle 12 is provided with armor for protecting the crew seated in the interior of the vehicle. As can be seen most clearly in FIG. 2, a plurality of forward mounted, forward looking seats 16, 18 and 20 are provided in the interior of the vehicle 12. Seat 16 is for the driver, seat 18 for the commander and seat 20 for the gunner. Each member of the crew is provided with his own access door, immediately adjacent to his respective seat. In this example there are four doors 22–28.

The crew's seating arrangement of this invention provides comfort and safety for the personnel. The crew members are seated in normal passenger car fashion with 360 degree visibility through windows surrounding the crew seating area. The gunner's seat is located outside of the turret 10 in a comfortable vehicle seat from which he can perform the gunner functions while seated and protected.

Figure 5:
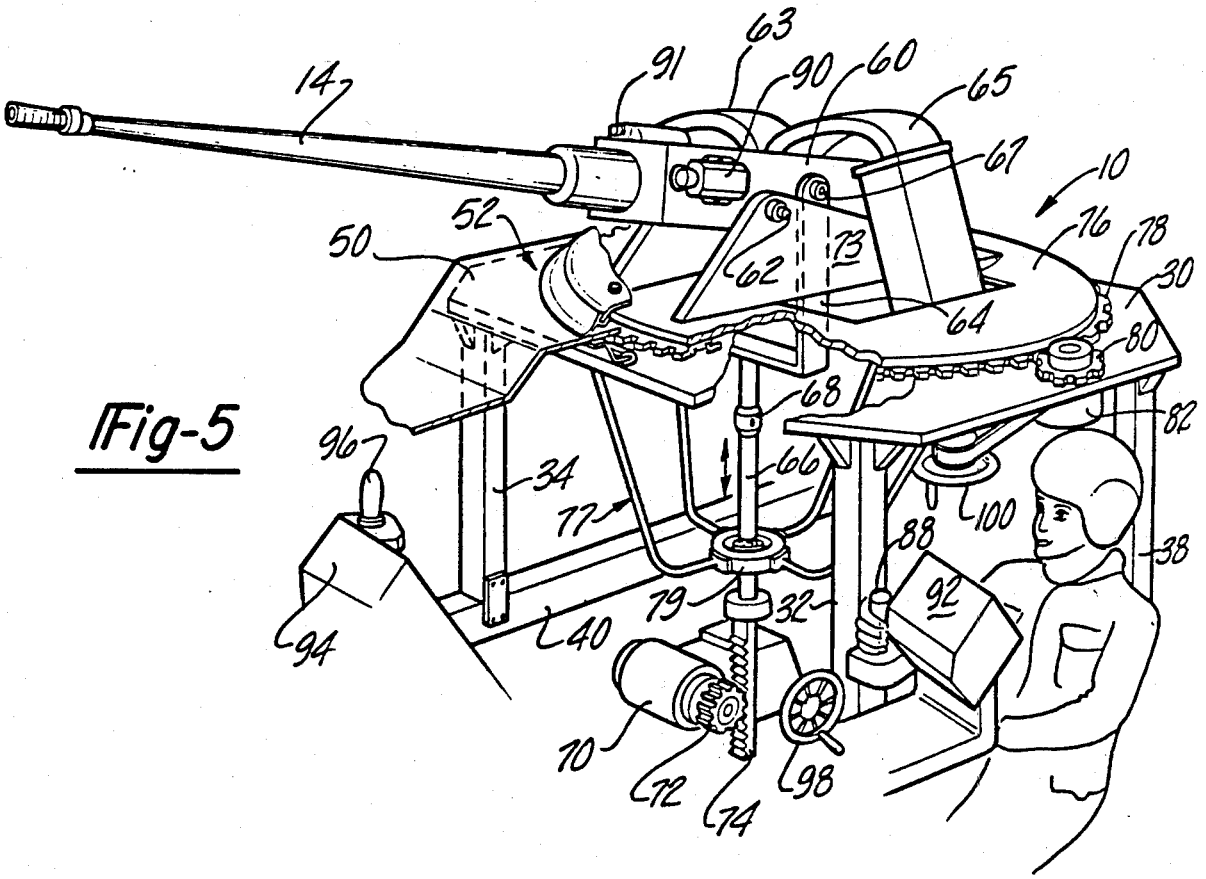
FIG. 5 is a perspective view with parts cut away of the turret construction preferably employed.

Turn now to the construction of turret 10 which is best illustrated in FIG. 5. A platform 30 having a generally rectangular periphery extends horizontally above the crew near the top of the vehicle 12. A plurality of vertically extending stanchions 32–38 are employed to support the platform 30. Upper ends of stanchions 32–38 are connected to lower portions of platform 30 and their lower ends are bolted to side rails 40 and 42 which are part of the vehicle frame. As can be seen most clearly in FIGS. 6 and 7, each stanchion includes a rectangular extruded aluminum casing 44 and an inner hollow aluminum tube 46. The space between outer casing 44 and tube 46 is filled with an energy absorbing elastomeric material 48. In the preferred embodiment, elastomeric material 48 is a polysulfide available from 3M Corporation as EC 801, which may be suitably mixed and poured within the space between casing 44 and tube 46 and allowed to cure. Suitable other energy absorbing materials such as sand may be used.

Figure 6:
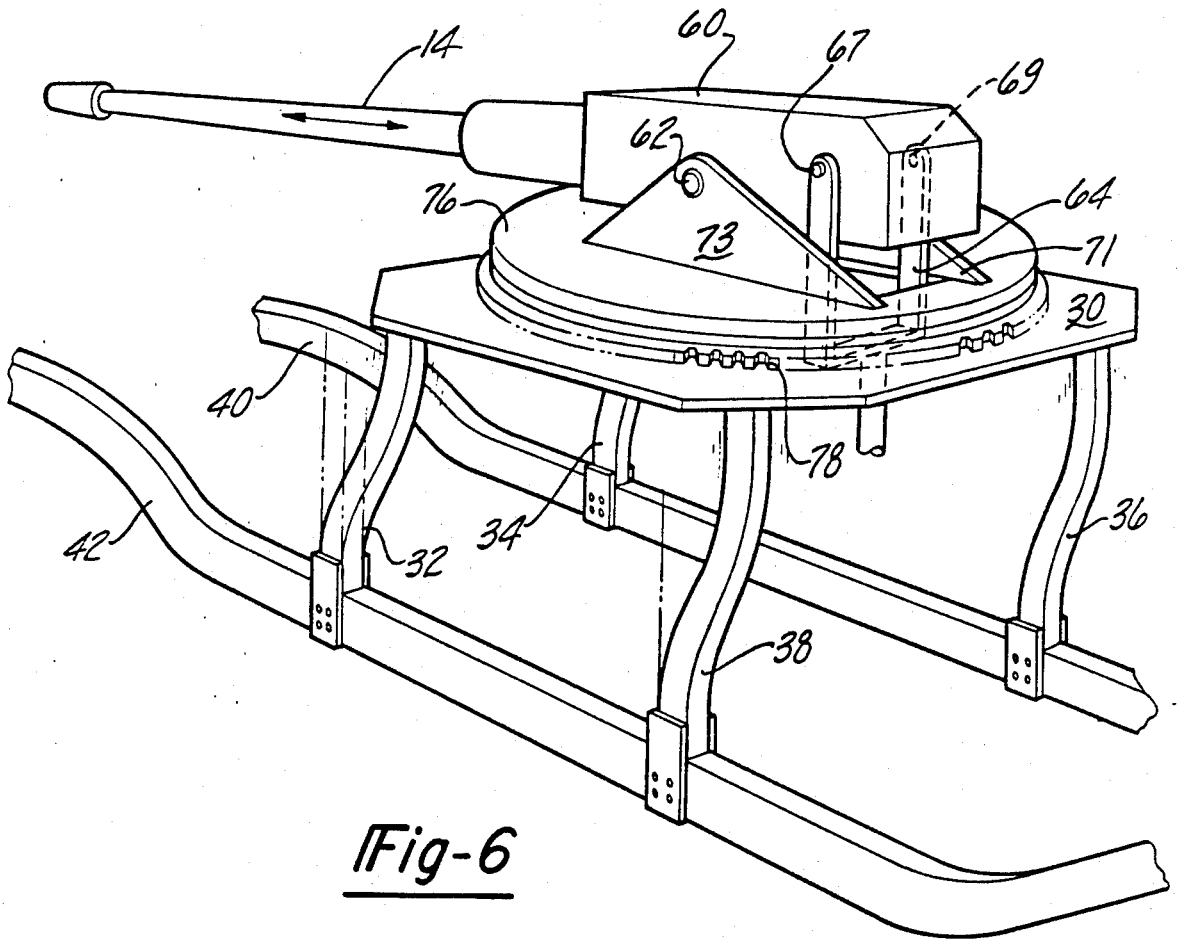
FIG. 6 is a perspective view diagramatically illustrating flexure of the turret stanchions during firing of the weapon.
Figure 7:
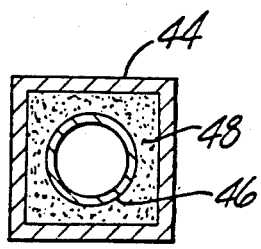
FIG. 7 is a cross sectional view through one of the stanchions.

Gun 14 is located centrally to the stanchions 32–38 so that the horizontal component of the gun impulse force is distributed amongst the stanchions. As shown in FIG. 6, the stanchions are designed to flex or deflect in response to the forces during firing of the gun and thereby isolate the vehicle frame from damage to a great extent. The elastomeric material 48 in each stanchion serves to absorb energy created by the weapon and prevents much of it from being transferred directly to the vehicle frame.

Figure 8:
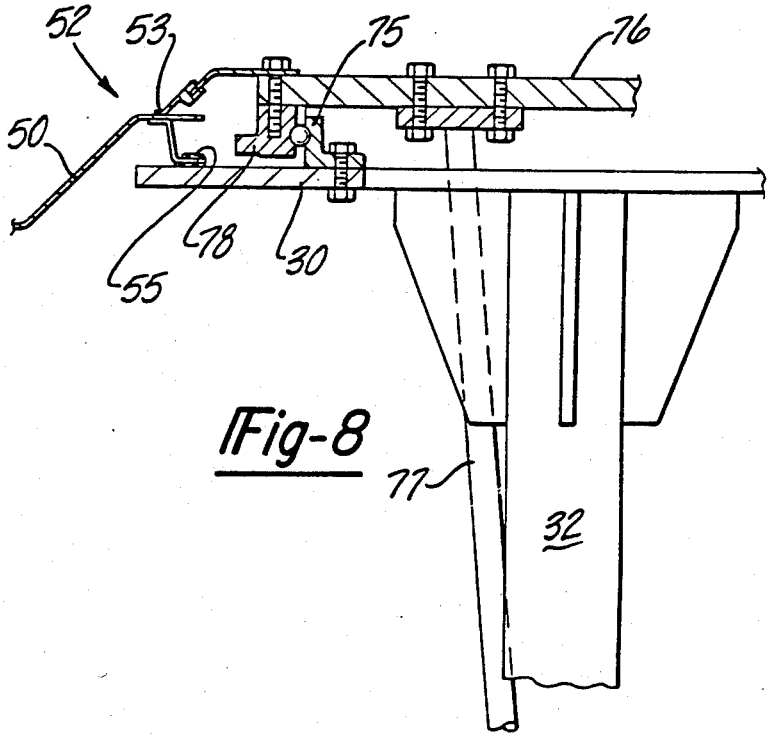
FIG. 8 is a cross sectional view illustrating in detail the turret bearing and sealing arrangements.

The platform 30 is free to move in the horizontal direction independently of the roof 50. As best shown in FIG. 8, there is a gap between roof 50 and platform 30. Weather seal 52 includes a resilient lip portion 53 riding on rood 50 that provides a friction joint with the roof or vehicle superstructure. Lower portions of seal 52 are connected to platform 30 by way of suitable fasteners 55.

Gun 14 is mounted in a cradle 60 which is pivotable about a pair of trunnions 62. Ammunition fed to the gun 14 by way of dual ammunition feeds 63 and 65. The cradle 60 includes a rearwardly extending portion connected to vertically extending struts of a yoke 64 through bearings 67 and 69. The lower portion of yoke 64 is pivotally connected to a shaft 66 by way of a ball and socket joint 68. Elevation of gun 14 is controlled by the vertical movement of shaft 66 likewise causing motion in the vertical direction of yoke 64 thereby pivoting the gun about its trunions 62. Power drive is provided via motor 70 controlling rotation of a pinion 72 in engagement with rack 74.

Azimuth control of gun 14 is provided by way of a rotating disk 76 to which cradle 60 is connected by way of trunnion mounts 71 and 73. As shown most clearly in FIG. 8, disk 76 is located within an opening in roof 50 and is bolted to a ring gear 78 which is incorporated in the outer race of the turret bearing whose inner race 75 is bolted to platform 30. Ring gear 78 includes radially extending teeth on its outer periphery. The teeth of gear 78 are meshed with a pinion 80 (FIG. 5) whose rotation is controlled by drive motor 82. In addition to its energy absorbing function, weather seal 52 bridges the gearing arrangement protecting it from adverse environmental conditions and also serving as a balistic shield.

Added stability for the elevation drive is provided by way of a basket 77. Basket 77 includes a plurality of struts whose upper ends are connected to the lower portions of platform 30 and whose lower ends are connected to a bearing guide 79 surrounding shaft 66.

As noted before, the gunner sits externally of the turret 10 in a comfortable and protected position within the vehicle. The gunner is provided with a suitable joy stick-type controller 88 for activating elevation motor 70 and azimuth motor 82 to aim the gun. A video camera 90 coaxially mounted to gun 14 is advantageously employed as a sighting device. An auxiliary laser beam sight 91 may also be employed. Camera 90 is connected to display 92 for viewing by the gunner. Other crew members such as the commander may also be provided with their own display and controller 94 and 96, respectively, so that they can also operate the weapon system, if desired.

The turret system of the present invention also preferably includes manual backup drives to control the gun in the event of power failure. To this end, a wheel 98 is connected by way of a clutching arrangement to drive pinion 72 in the event of power loss. Additionally, a wheel 100 suitably connected to pinion 80 via a belt or chain is employed for effecting azimuth movement of the gun.

Among the advantages of the present invention is that various weapon stations can be interchangeably used with this construction. Each weapon station would include a particular type of weapon mounted on its own disk in a manner like that described above. Each weapon station can be easily removed from the vehicle by unbolting the disk 76, disconnecting yoke 64, and disconnecting the cables coupling camera 90 to the video displays and controllers 92, 96 to the weapon firing mechanisms (not shown). The weapon station can then be lifted from the vehicle and a new weapon station with a similar mounting scheme reattached. The video displays, gunner controls, manual and power drives all remain fixed and are common to all weapon variants. This system is ideally suited, but not limited to weapons such as a 30 mm chain gun, Tow family of missiles, 40 mm grenade launcher, .50 caliber machine guns, 7.62 mm machine guns and other high velocity guns including the illustrated 25 mm chain gun.

The unmanned turret system of this invention extends the capability of lightweight conventional vehicles to support high impulse weapons. This allows the light vehicle to employ high impulse cannons designed to deliver ammunition at extended ranges.

Various other advantages and modifications of the illustrated embodiment of this invention will become apparent to those skilled in the art after a study of the drawings, specification and following claims.

We claim:

1. A military land vehicle having a roof and an interior volume having at least one passenger seat, the vehicle permitting interchangeability of different weapon stations, each weapon station including a weapon mounted on a disk, the vehicle comprising:

a platform located interiorly of an opening in the roof of the vehicle, the platform having a generally flat upper surface and an aperture therethrough, lower portions of the platform being connected to a frame for the vehicle by way of a plurality of flexible stanchions spaced about the periphery of the platform;

azimuth drive means on the upper surface of the platform for rotating the disk about 360 degrees, said azimuth drive means having at least one electric motor driving a gear assembly mounted to the upper platform surface;

means for removably attaching the disk of the desired weapon station to the gear assembly of the azimuth drive means;

elevation drive means including a ball and socket joint located in the interior of the vehicle and extending through the aperture in the platform; and connection means for removably connecting the elevation drive means to the weapon.

2. The vehicle of claim 1 wherein said azimuth drive means includes:

turret bearing means having a ring gear to which the disk is removably attached, and a pinion for engaging radially extending teeth on the surface of the ring gear.

3. The vehicle of claim 2 wherein said weapon station includes cradle means for receiving a weapon in such manner so as to pivot the weapon in elevation about a pair of trunnions, and wherein said elevation drive means includes:

a vertically movable member removably attached to the cradle means, and a motor within the vehicle for controlling vertical movement of said member to thereby move the gun in elevation; and power control means for automtically energizing the motors of the azimuth and elevation drive means.

4. The vehicle of claim 3 wherein said member is rotatably connected to the drive means said of a ball and socket joint to permit said member to rotate with the disk during azimuth positioning thereof.

5. The vehicle of claim 1 wherein the stanchions are filled with an energy absorbing material.

6. A military vehicle comprising:

an interior volume having at least one passenger seat;

a platform connected to the vehicle by way of a plurality of flexible stanchions;

a disk having a weapon mounted thereon capable of pivoting in elevation;

a ring gear having an inner race and an outer race, means for connecting the inner race of the ring gear to the platform, the outer race including a plurality of radially extending teeth;

means for removably connecting said disk together with its associated weapon to the outer race of said ring gear;

azimuth drive means on the platform and spaced from the disk for engaging the teeth of said ring gear to rotate the disk and position the weapon in azimuth;

elevation drive means in the vehicle and removably connected to said weapon for controlling elevation thereof, said elevation drive means including a ball and socket joint; and power control means having a controller accessible from the passenger seat for selectively activating the azimuth and elevation drive means to thereby automatically control the position of the weapon.

7. The vehicle of claim 6 wherein the azimuth drive means includes:

a driven pinion mounted on the platform and engaging said ring gear, and a motor in the vehicle connected to said power control means.

8. The vehicle of claim 7 wherein said vehicle includes manual control means for manually moving the weapon, said manual control means including a first wheel coupled to the pinion of the azimuth drive means, with the wheel being capable of being manually rotated by a person from his seat in the vehicle to thereby manually position the weapon in azimuth.

9. The vehicle of claim 8 wherein the elevation drive means includes:

a first elongated member centrally located about the axis of rotation of the disk, a second member extending through the disk and removably connected to the weapon, and said ball and socket joint defining a rotating coupling between the first and second members constructed so that vertical movement of the first member controls elevation of the weapon, with said second member being capable of rotating with the weapon during azimuth positioning thereof.

10. The vehicle of claim 9 wherein said first member comprises a rack, the elevation drive means includes a pinion for engaging the rack, with the power control means including a motor for imparting rotational movement to the pinion thereby controlling vertical movement of the rack, and wherein said manual control means further includes means for manually rotating the pinion to control elevation of the weapon.

11. The vehicle of claim 10 wherein the second member includes a yoke removably connected to trunnions on the weapon.

12. The vehicle of claim 6 wherein said vehicle is a land vehicle having a plurality of forward looking seats, one of the seats being a gunner's seat, and wherein said vehicle further includes exterior side doors adjacent each seat.

13. The vehicle of claim 9 wherein the vehicle includes a roof portion having an opening therein, said platform being located beneath said opening, with said disk being located within the opening and spaced from the roof, with the vehicle further including weather seal means bridging the space between said disk and said roof, with the weather seal means being connected at inner portions thereof to the disk and extending generally radially outwardly therefrom.

14. The vehicle of claim 13 wherein the outer portion of said weather seal means includes a resilient means contacting the roof.

15. The vehicle of claim 6 wherein the stanchions are filled with an energy absorbing material.

* * * * *